US007646150B2

(12) United States Patent
Cho et al.

(10) Patent No.: US 7,646,150 B2
(45) Date of Patent: Jan. 12, 2010

(54) PLASMA DISPLAY PANEL AND MANUFACTURING METHOD OF THE SAME

(75) Inventors: Tae-Seung Cho, Suwon-si (KR); Jeong-Nam Kim, Suwon-si (KR); Hyea-Weon Shin, Suwon-si (KR); Yong-Shik Hwang, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 379 days.

(21) Appl. No.: 11/808,737

(22) Filed: Jun. 12, 2007

(65) Prior Publication Data

US 2008/0001853 A1 Jan. 3, 2008

(30) Foreign Application Priority Data

Jun. 30, 2006 (KR) ..... 10-2006-0060673

(51) Int. Cl.
*H01J 17/49* (2006.01)

(52) U.S. Cl. ..... 313/583; 313/584; 313/585

(58) Field of Classification Search ..... 313/583–585
See application file for complete search history.

(56) References Cited

U.S. PATENT DOCUMENTS

| | | | | |
|---|---|---|---|---|
| 7,521,866 | B2 * | 4/2009 | Jung et al. | 313/582 |
| 2003/0168977 | A1 * | 9/2003 | Hashikawa | 313/582 |
| 2004/0245929 | A1 * | 12/2004 | Sakamoto | 313/584 |
| 2005/0264203 | A1 * | 12/2005 | Hur et al. | 313/583 |
| 2006/0087234 | A1 * | 4/2006 | Hur et al. | 313/582 |
| 2006/0103311 | A1 * | 5/2006 | Hur et al. | 313/584 |
| 2006/0103312 | A1 * | 5/2006 | Hur et al. | 313/585 |

FOREIGN PATENT DOCUMENTS

JP 2006120615 A 5/2006

* cited by examiner

*Primary Examiner*—Peter Macchiarolo
(74) *Attorney, Agent, or Firm*—Robert E. Bushnell, Esq.

(57) ABSTRACT

A plasma display panel that is capable of reducing power consumption and improving exhaust efficiency. The plasma display panel includes a first substrate, a second substrate facing the first substrate, a plurality of discharge cells partitioned between the first substrate and the second substrate, a plurality of phosphor layers arranged within the plurality of discharge cells, a plurality of address electrodes extending in a first direction on the second substrate and a plurality of first electrodes and a plurality of second electrodes extending in a second direction that crosses the first direction, arranged between the first substrate and the second substrate, arranged apart from the plurality of address electrodes, and protruding in a third direction away from the second substrate, wherein the plurality of first electrodes and the plurality of second electrodes face each other with a space therebetween, wherein each of the plurality of first electrodes and each of the plurality of second electrodes respectively include a plurality of expanded portions corresponding to respective ones of the plurality of discharge cells and extending in the third direction, and a plurality of connecting portions connecting ones of the plurality of expanded portions.

20 Claims, 12 Drawing Sheets

PLASMA DISPLAY PANEL AND MANUFACTURING METHOD OF THE SAME

CLAIM OF PRIORITY

This application makes reference to, incorporates the same herein, and claims all benefits accruing under 35 U.S.C. §119 from an application for PLASMA DISPLAY PANEL AND MANUFACTURING METHOD OF THE SAME earlier filed in the Korean Intellectual Property Office on 30 Jun. 2006 and there duly assigned Serial No. 10-2006-0060673.

BACKGROUND OF THE INVENTION

1. Field of the Invention

A plasma display panel (PDP) having a structure of opposed discharge and that is capable of reducing power consumption and improving exhaust efficiency.

2. Description of the Related Art

A PDP displays an image by using visible light generated when vacuum ultraviolet rays radiating from plasma generated by a gas discharge excite a phosphor material. The PDP enables extra-large screens of larger than 60 inches to be thinner than 10 cm. In addition, the PDP is a self-emissive display device like a cathode ray tube (CRT), and has excellent capacity for reproducing colors and without distortion at various viewing angles. The PDP has advantages of greater productivity and lower cost due to a simpler method of manufacturing than for a liquid crystal display (LCD), and is spotlighted as the next generation industrial flat panel display and home TV display.

The structure of the PDP has been developed for many years, since the 1970s, and the generally-known structure now is a three-electrode surface discharge PDP. The three-electrode surface discharge PDP includes one substrate that includes two electrodes arranged on the same surface, and another substrate that is arranged at a certain distance therefrom and includes address electrodes extending in a perpendicular direction. A discharge gas is filled in the space between the pair of substrates and the substrates are sealed against each other.

Generally, whether or not the discharge occurs is determined by the discharge of scan electrodes that are connected to each line and independently controlled, and address electrodes facing the scan electrodes. In addition, sustain discharge that displays brightness is generated by two electrode groups, namely sustain electrodes and scan electrodes, that are located on the same surface.

When a discharge occurs between the sustain electrodes and the scan electrodes, a voltage distribution between the sustain electrodes and the scan electrodes shows a distortion due to a space charge effect that occurs at dielectric layers around the sustain electrodes and the scan electrodes. More specifically, in an AC three-electrode surface discharge PDP, a sustain electrode and a scan electrode operate alternately as an anode and a cathode, and thus a voltage distribution between the anode and the cathode becomes distorted.

That is, a cathode sheath is formed around the cathode, an anode sheath is formed around the anode, and a positive column is formed therebetween. Most of the voltage that is applied between the anode and the cathode is consumed by the cathode sheath, part of the voltage is consumed in the anode sheath, and little voltage is consumed in the positive column. It is known that electron heating efficiency in the cathode sheath depends on a secondary electron emission factor of a protective layer (typically a MgO layer) formed on the surface of a dielectric layer, and most voltage that is applied is consumed to heat electrons in the positive column.

Vacuum ultraviolet rays that collide with phosphor and produce visible light are generated during a transition of xenon (Xe) gas in an excited state into a stable state, and the excited state of xenon is provided by collision of xenon gas with electrons. Therefore, in order to increase a ratio of voltage generating visible light to voltage applied (that is, radiation efficiency), the ratio of voltage contributing to a discharge of xenon gas to voltage applied (that is, discharge efficiency) should be improved, and in order to improve the discharge efficiency collisions of xenon gas with electrons, electron heating efficiency should be improved.

Although most of the applied voltage is consumed in the cathode sheath, the electron heating efficiency is low. In the positive column, little of the applied voltage is consumed and the electron heating efficiency is very high. In addition, the cathode sheath and the anode sheath occupy a nearly constant space regardless of a distance between the sustain electrode and the scan electrode. Therefore, in order to accomplish high discharge efficiency, the positive column should be enlarged, and in order to enlarge the positive column, a PDP that has an opposed discharge structure and that is capable of increasing the distance and the opposing area between the sustain electrode and the scan electrode is needed.

A typical PDP has low exhaust efficiency and thus has various problems. In other words, when the exhaust efficiency is low, impurities generated during a discharge continue to remain in discharge spaces. Therefore, what is needed is a design for a PDP that improves discharge efficiency and exhaust efficiency while being easy to make.

SUMMARY OF THE INVENTION

The embodiments of the present invention provide an opposed discharge type of PDP that is capable of reducing power consumption while increasing the opposed area between sustain electrode and scan electrode.

The embodiments of the present invention also provide an opposed discharge type of PDP that is capable of improving exhaust efficiency by forming exhaust paths between adjacent discharge spaces.

The embodiments of the present invention also provide a simple manufacturing method of a PDP that is capable of improving exhaust efficiency and reducing power consumption.

According to one aspect of the invention, a PDP is provided having a first substrate, a second substrate facing the first substrate, a plurality of discharge cells partitioned between the first substrate and the second substrate, a plurality of phosphor layers arranged within the plurality of discharge cells, a plurality of address electrodes extending in a first direction on the second substrate and a plurality of first electrodes and a plurality of second electrodes extending in a second direction that crosses the first direction, arranged between the first substrate and the second substrate, arranged apart from the plurality of address electrodes, and protruding in a third direction away from the second substrate, wherein the plurality of first electrodes and the plurality of second electrodes face each other with a space therebetween, wherein each of the plurality of first electrodes and each of the plurality of second electrodes respectively include a plurality of expanded portions corresponding to respective ones of the plurality of discharge cells and extending in the third direction, and a plurality of connecting portions connecting ones of the plurality of expanded portions in the second direction and forming stepped portions therefrom, and wherein a plurality of first apertures that communicate with the plurality of discharge cells adjacent to each other along the first direction are arranged between the ones of the plurality of connecting portions that are adjacent to each other in the second direction.

Each of the plurality of first electrodes and each of the plurality of second electrodes can be arranged alternately along the first direction and are arranged to pass a boundary between ones of the plurality of discharge cells that are adjacent to each other along the first direction. The connecting portions can be located within a boundary between ones of the plurality of discharge cells that are adjacent to each other along the second direction, and a plurality of second apertures can be arranged between ones of the plurality of connecting portions that are adjacent to each other along the first direction, and communicate with ones of the plurality of discharge cells that are adjacent to each other along the second direction. A length of ones of the plurality of connecting portions measured along the second direction can be smaller than a length of ones of the plurality of the expanded portions measured along the second direction, and a length of ones of the plurality of connecting portions measured along the third direction is smaller than a length of ones of the plurality of expanded portions measured along the third direction. Ones of the plurality of connecting portions can be arranged further along the third direction from the second substrate than ones of the plurality of expanded portions.

The PDP can further include a first dielectric layer and a second dielectric layer can be arranged on surfaces of the plurality of first electrodes and the plurality of second electrodes, wherein the first dielectric layer can include a plurality of first dielectric members extending along the first direction and a plurality of second dielectric members extending along the second direction that crosses the first dielectric members, and wherein the second dielectric layer includes a plurality of third dielectric members extending along the second direction on the plurality of second dielectric members. A plurality of first discharge spaces can be defined by the plurality of first, second, and third dielectric members. The PDP can further include a plurality of barrier ribs arranged on the first substrate and partitioning a plurality of second discharge spaces that face the plurality of first discharge spaces, the plurality of discharge cells being defined by the plurality of first and second discharge spaces. The plurality of barrier ribs can include a plurality of first barrier rib members that correspond to the plurality of first dielectric members and extend along the first direction and a plurality of second barrier rib members that correspond to the second and third dielectric members respectively and extend along a direction crossing the plurality of first barrier rib members, wherein the plurality of phosphor layers can be arranged on the sides of the plurality of first and second barrier rib members and on the first substrate. The plurality of address electrodes can include a plurality of bus electrodes extending along the first direction and a plurality of transparent electrodes protruding from ones of the plurality of bus electrodes into centers of respective ones of the plurality of discharge cells, and wherein the plurality of bus electrodes can be arranged on boundaries of the plurality of discharge cells that are adjacent to each other along the second direction. The plurality of transparent electrodes can be arranged closer to ones of the plurality of second electrodes than to ones of the plurality of first electrodes.

According to another aspect of the present invention, there is provided a method of making a PDP that includes forming a first dielectric layer on a substrate, etching the first dielectric layer to form a first plurality of grooves for a plurality of discharge spaces and a second plurality of grooves for a plurality of first and second electrodes that are defined by a plurality of first dielectric members and a plurality of second dielectric members that cross the plurality of first dielectric members, continuously distributing an electrode paste into the second plurality of grooves that are arranged along a second direction crossing the first direction, and on parts of the plurality of first dielectric members to form the plurality of first and second electrodes and forming a plurality of third dielectric members along the second direction and covering the plurality of first and second electrodes.

The first dielectric layer can be etched by a sand blasting process. The first dielectric layer can be etched by an etching process. The first plurality of grooves and the second plurality of grooves can be formed simultaneously. During the forming of the grooves for the plurality of discharge spaces and the grooves for the plurality of electrodes, a height of ones of the plurality of first dielectric members that define the second plurality of grooves for the plurality of first and second electrodes measured from the substrate can be formed to be greater than a height of ones of the plurality of second dielectric members. The forming of the plurality of first and second electrodes can include continuously distributing the electrode paste along the second direction and forming a plurality of expanded portions that are filled into the second plurality of grooves and a plurality of connecting portions that are formed on the first dielectric members to form a plurality of stepped portions from the plurality of expanded portions and connect the plurality of expanded portions along the second direction. The electrode paste can be filled into the second plurality of grooves by a dispenser. The electrode paste can be formed in the second plurality of grooves by a pattern printing process. The plurality of third dielectric members can be formed by a pattern printing process.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
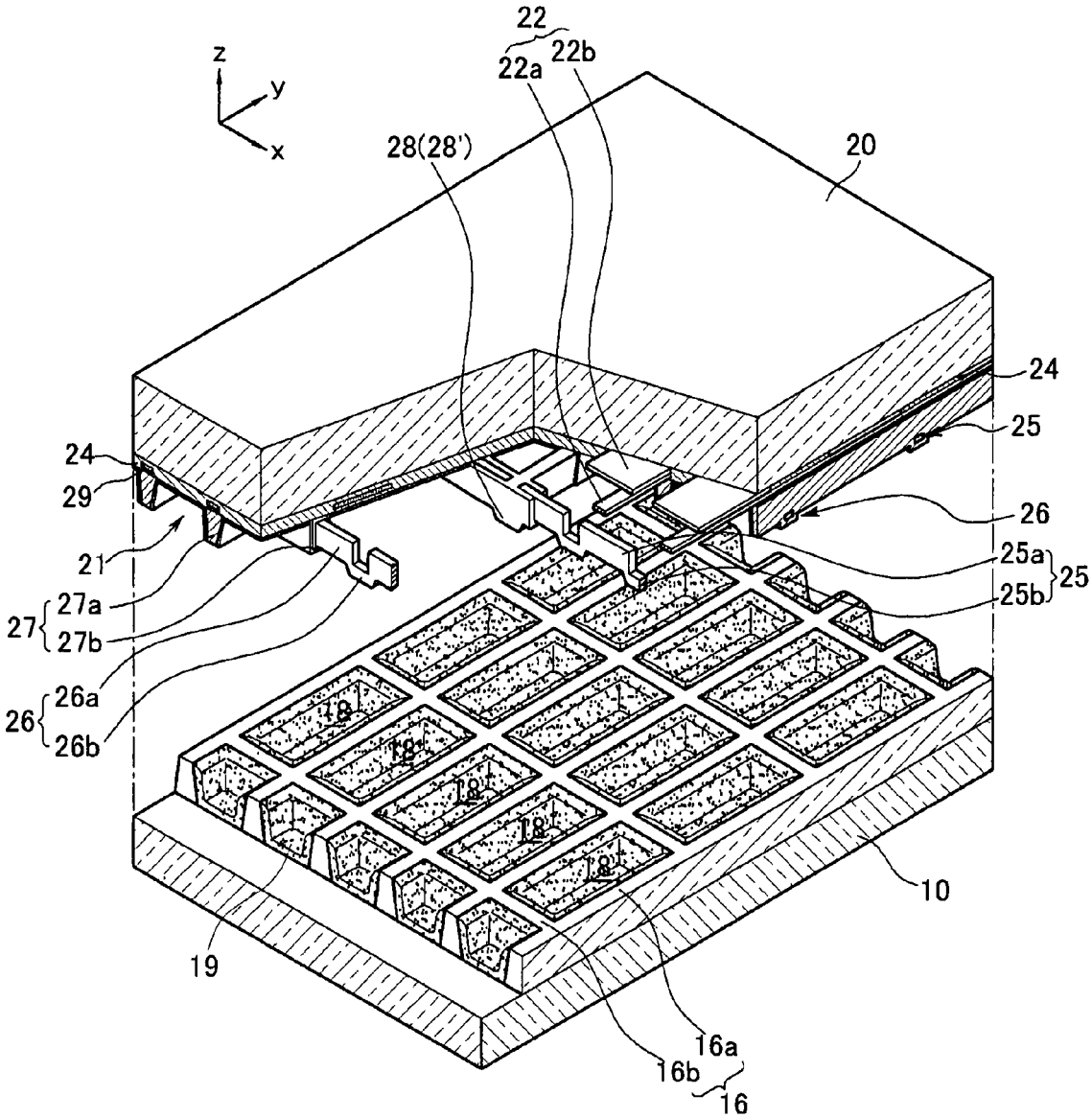
FIG. 1 is a partial exploded perspective view showing a PDP according to a first embodiment of the present invention.
Figure 2:
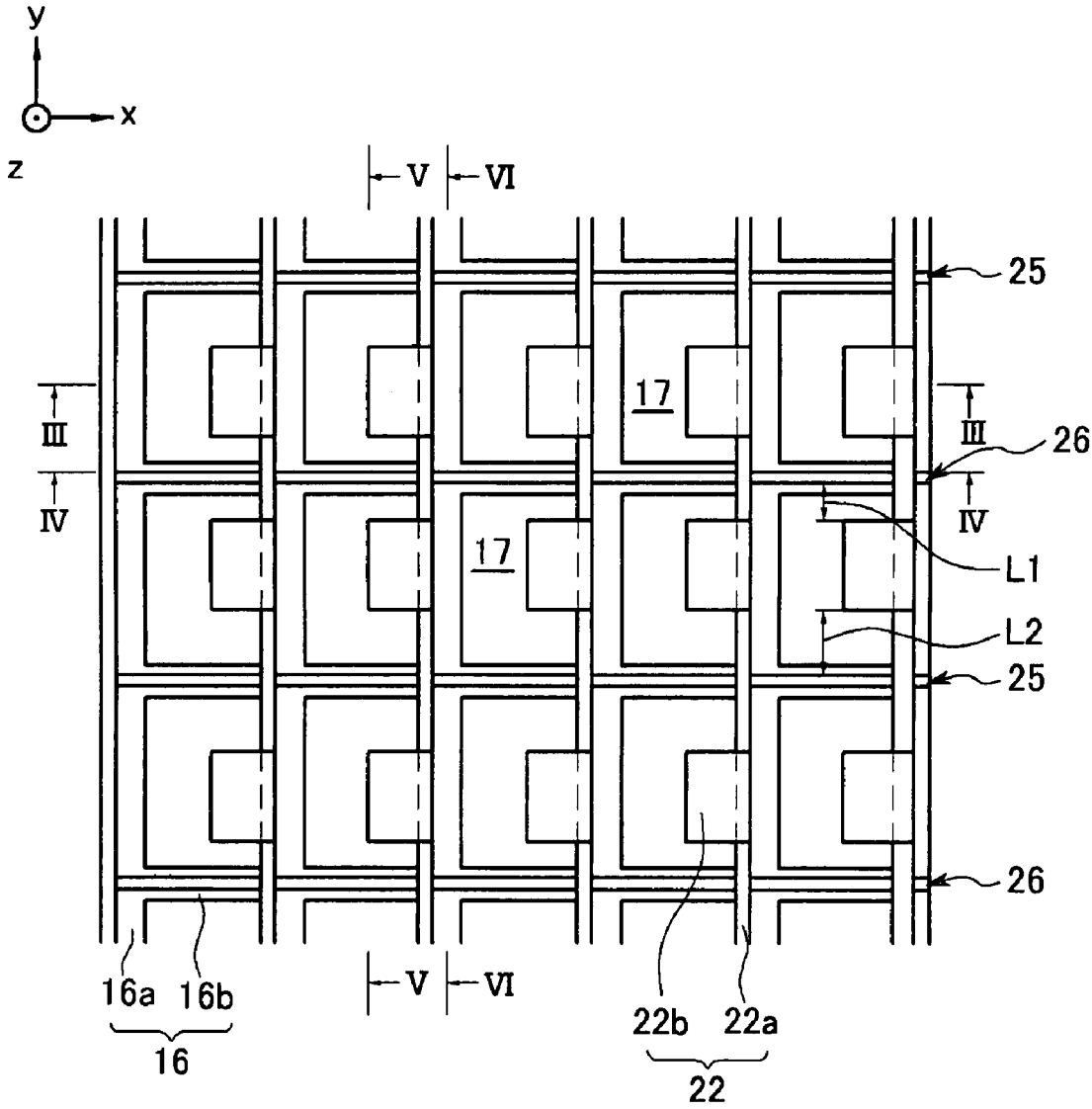
FIG. 2 is a partial plan view schematically showing structures of electrodes and discharge cells of the PDP according to the first embodiment of the present invention.

Referring to FIG. 1 and FIG. 2, the plasma display panel (PDP) of the first embodiment of the present invention includes a first substrate (hereinafter referred to as a rear substrate) 10 and a second substrate (hereinafter referred to as a front substrate) 20 facing each other with a certain distance therebetween. A plurality of discharge spaces 18 and 21 are partitioned between the rear substrate 10 and the front substrate 20. Phosphor layers 19 are formed within the discharge spaces 18, and they absorb ultraviolet rays and radiate visible light. The discharge spaces 18 and 21 are filled with a discharge gas (for example a gas mixture including xenon (Xe), neon (Ne), etc.) in order to produce plasma discharge.

Address electrodes 22 extend in a first direction (y-axis direction in the drawings) on a surface of the front substrate 20 facing the rear substrate 10. The address electrodes 22 are arranged parallel to and spaced apart from each other. A dielectric layer 24 is formed on the front substrate 20 and covers the address electrodes 22. First electrodes (hereinafter referred to as sustain electrodes) 25 and second electrodes (hereinafter referred to as scan electrodes) 26 are formed on the dielectric layer 24 and extend in a second direction that crosses the first direction. The sustain electrodes 25 and the scan electrodes 26 protrude toward the rear substrate 10 in a third direction (z-axis direction in the drawings) that is perpendicular to the first and second direction and away from the front substrate 20. The sustain electrodes 25 and the scan electrodes 26 are formed to face each other with a space therebetween.

According to the present embodiment, each of the sustain electrodes 25 and the scan electrodes 26 respectively includes expanded portions 25*a* and 26*a* that correspond to respective discharge spaces 18, 21 and extend in the third direction, and connecting portions 25*b* and 26*b* that connect the expanded portions 25*a* and 26*a* along the second direction and form stepped portions therefrom.

A first dielectric layer 27 and a second dielectric layer 28' are formed to cover the sustain electrodes 25 and the scan electrodes 26. A protective layer 29, for example a MgO layer, is formed on the outer surfaces of the first dielectric layer 27 and the second dielectric layer 28'. The first dielectric layer 27 includes first dielectric members 27*a* and second dielectric members 27*b*. The first dielectric members 27*a* extend along a first direction, and the second dielectric members 27*b* extend along a second direction that crosses the first dielectric members 27*a*. The second dielectric layer 28' includes third dielectric members 28 that are formed along the second direction on the second dielectric members 27*b*. A plurality of first discharge spaces 21 are defined by the first, second, and third dielectric members 27*a*, 27*b*, and 28.

Barrier ribs 16 partitioning a plurality of second discharge spaces 18 are formed on the surface of the rear substrate 10 that faces the front substrate 20. The barrier ribs 16 include first barrier rib members 16*a* and second barrier rib members 16*b*. The first barrier rib members 16*a* correspond to the first dielectric members 27*a* and extend along the first direction. The second barrier rib members 16*b* correspond to the second dielectric members 27*b* and are formed to intersect the first barrier rib members 16*a*. The second discharge spaces 18 are defined by the first and second barrier rib members 16*a* and 16*b*.

It is to be understood that the structure of the barrier ribs 16 are not limited to the above-described structure. A stripe-type barrier rib structure including barrier rib members parallel only to the first direction can be applied to the present invention, and also belongs to the scope of the present invention. In addition, according to the present embodiment, the barrier ribs 16 are formed on the rear substrate 10. However, the barrier ribs 16 can be formed by etching the rear substrate 10 and still be within the scope of the present invention.

According to the present embodiment, the first discharge spaces 21 are defined on the front substrate 20 by the first, second, and third dielectric members 27*a*, 27*b*, and 28, and the second discharge spaces 18 are defined on the rear substrate 10 by the first and second barrier rib members 16*a* and 16*b*. Each of the first discharge spaces 21 and the second discharge spaces 18 are formed in shapes corresponding to each other, thus substantially forming a discharge cell 17.

Phosphor layers 19 are formed within the discharge cells 17. More particularly, the phosphor layers 19 are formed in the second discharge spaces 18 that are formed on the rear substrate 10. As stated above, the address electrodes 22 are formed on the front substrate 20 and the phosphor layers 19 are formed on the rear substrate 10, thus there is an advantage that a discharge firing voltage is evenly produced in each discharge cell 17 during address discharge.

In other words, the phosphor layers have been located between the address electrodes and the scan electrodes to enable address discharge in a three-electrode surface discharge PDP, and there has been a drawback of uneven discharge firing voltage due to different permittivities between red, green, and blue phosphor layers in such PDPs. According to the present embodiment, however, the address electrodes 22 and the scan electrodes 26 that enable address discharge are arranged on the front substrate 20 and the phosphor layers 19 are formed on the rear substrate 10, thus the above problem is solved.

Since the address discharge occurs between the address electrodes 22 on the front substrate 20 and the scan electrodes 26 near the front substrate 20, electrical charges do not accumulate on the phosphor layer 19 on the rear substrate 10 during address discharge. Therefore, a durability loss of phosphor by ion sputtering of the accumulated charges on the phosphor layer 19 can be prevented.

Referring to FIG. 2, the address electrodes 22 extend along a first direction (y-axis direction in the drawings) and include bus electrodes 22*a* and transparent electrodes 22*b*. The bus electrodes 22*a* correspond to the first barrier rib members 16*a* and extend along the first direction. The transparent electrodes 22*b* correspond to each discharge cell 17 and expand from the bus electrodes 22*a* toward the center of each discharge cell 17.

In this case, the transparent electrodes 22*b* can be made of indium tin oxide (ITO) to ensure adequate aperture ratio for the front substrate 20. Although the transparent electrodes are in the shape of a rectangle in the present embodiment, transparent electrodes of other shapes can instead be used. For example, transparent electrodes in a triangular shape gradually decreasing in size along a direction from the scan electrodes 26 toward the sustain electrodes 25 can be applied to the present embodiment and belong to the scope of the present invention. The bus electrodes 22*a* can be made of a metal so as to ensure high conductivity by compensating for high electrical resistance of the transparent electrodes. According to the present embodiment, the bus electrodes 22*a* are located on the boundaries of the discharge cells 17 adjacent to each other along the second direction (x-axis direction in the drawings). Thus, the present embodiment has the advantage that the aperture ratio for the front substrate 20 does not decrease, even though the bus electrodes 22*a* are made of an opaque metal.

The sustain electrodes 25 and the scan electrodes 26 are formed along a direction intersecting the address electrodes 22. In the present embodiment, the sustain electrodes 25 and the scan electrodes 26 are located on the boundaries of discharge cells 17 adjacent to each other along the first direction (y-axis direction in the drawings), and are arranged alternately along the first direction. The scan electrodes 26 enable address discharge by interacting with the address electrodes 22 during an address period. The discharge cells 17 to be turned on are selected by the address discharge. The sustain electrodes 25 enable sustain discharge by interacting mainly with the scan electrodes 26. Images are displayed through the front substrate 20 by the sustain discharge. However, the role of each electrode varies with the kind of voltage supplied to the electrode and is not limited to the above.

In the present embodiment, transparent electrodes 22*b* of the address electrodes 22 are formed closer to the scan electrodes 26 than the sustain electrodes 25. That is, when a distance between the transparent electrodes 22*b* and the scan electrodes 26 is assumed to be L1 and a distance between the transparent electrodes 22*b* and the sustain electrodes 25 is assumed to be L2, L1 is smaller than L2. Due to the above-describe structure, a discharge between the scan electrodes and the transparent electrodes 22*b* can easily occur during address discharge that selects discharge cells 17 to be turned on.

The sustain electrodes 25 and the scan electrodes 26 also are formed of metal. In other words, in the present embodiment, the sustain electrodes 25 and the scan electrodes 26 are located on the boundaries of discharge cells adjacent to each other along the first direction (y-axis direction in the drawings), so that the aperture ratio does not decrease even if the electrodes are made of metal.

Figure 3:
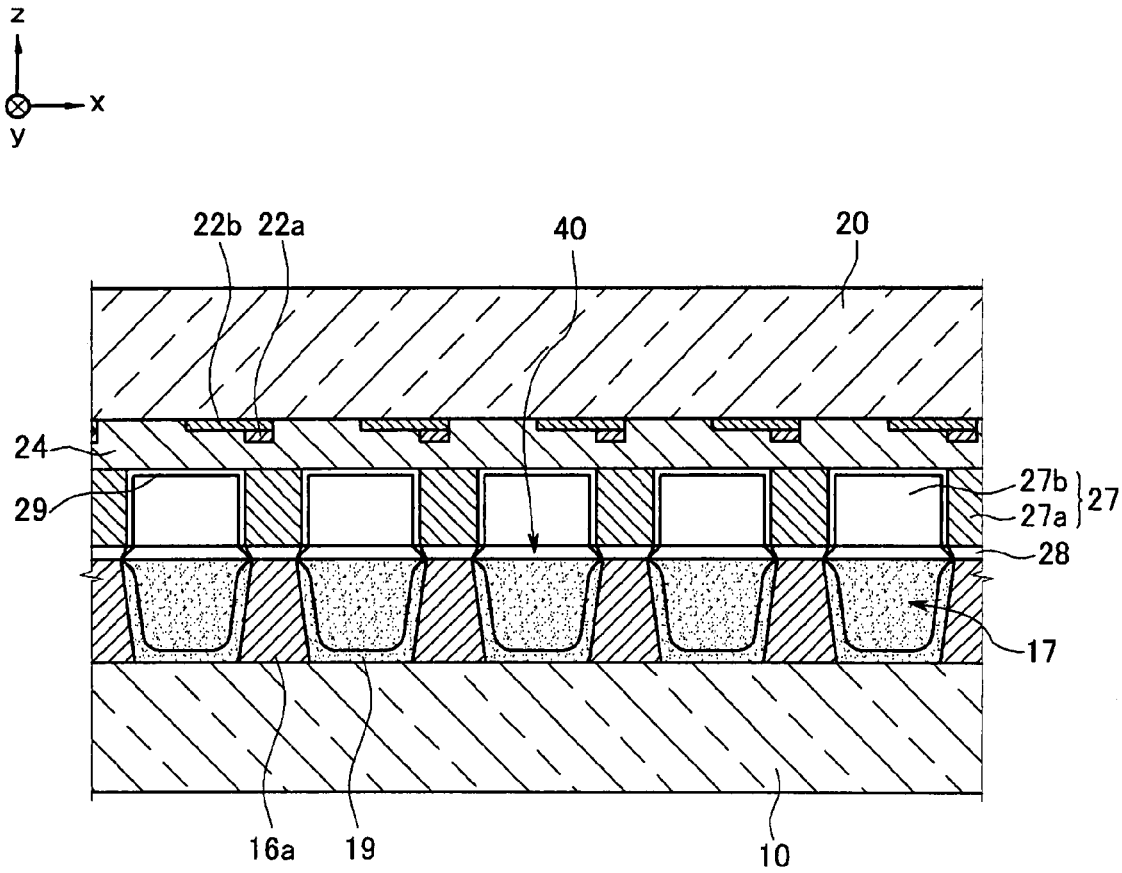
FIG. 3 is a cross-sectional view showing the assembled PDP, taken along line III-III in FIG. 2.

Referring to FIG. 3, in the present embodiment, the third dielectric members 28 protrude at intersections of the first dielectric members 27*a* and the second dielectric members 27*b*. That is, the third dielectric members 28 protrude toward the rear substrate further than the first and second dielectric members 27*a* and 27*b*, thus first apertures 40 are formed between the first dielectric members 27*a* adjacent to each other along the second direction (x-axis direction in the drawings). Since first apertures 40 that communicate with discharge cells 17 adjacent to each other along the first direction (y-axis direction in the drawings) are formed between the second dielectric members 27*b* and the rear substrate 10, the exhaust efficiency in the discharge cells 17 can be improved. The first apertures 40 can be formed on the sustain electrodes 25 and the scan electrodes 26, respectively. Structures of the first apertures 40 that are formed on the sustain electrodes 25 and the scan electrodes 26 are identical, thus the following description is concerned with the structure of the first apertures 40 that are formed on the scan electrodes 26.

Figure 4:
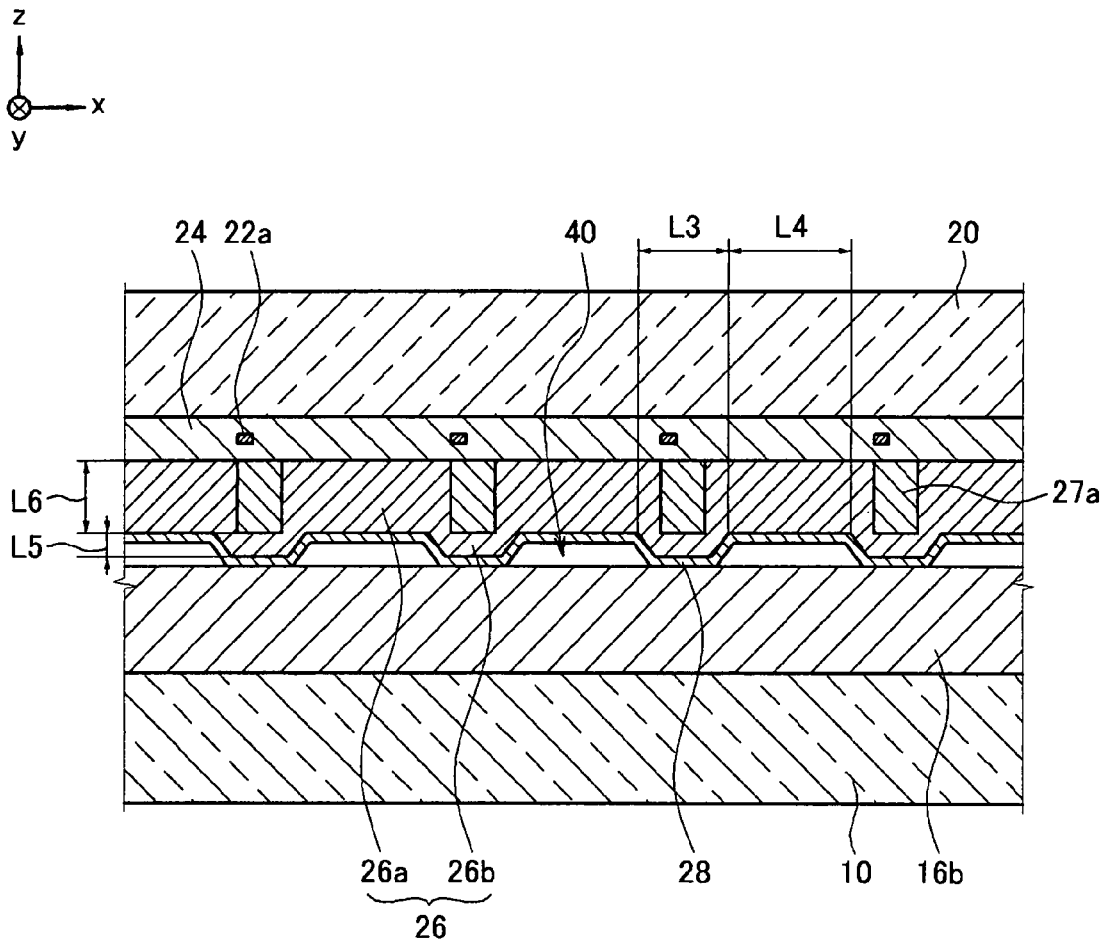
FIG. 4 is a cross-sectional view showing the assembled PDP, taken along line IV-IV in FIG. 2.

Referring to FIG. 4, the scan electrodes 26 extend along the second direction (x-axis direction in the drawings), and the shape of the scan electrodes 26 changes along the second direction. The scan electrodes 26 according to the present embodiment include the expanded portions 26*a* that correspond to the respective discharge cells 17 and extend along the third direction (z-axis direction in the drawings), and the connecting portions 26*b* that connect the expanded portions 26*a* along the second direction (x-axis direction in the drawings) and form stepped portions from the expanded portions 26*a*.

That is, the expanded portions 26*a* of the scan electrodes 26 extend along the second direction, and the connecting portions 26*b* of the scan electrodes 26 are located on the boundaries of discharge cells 17 adjacent to each other along the second direction and are formed along the bottom surfaces of the first dielectric members 27*a*. As stated above, since the connecting portions 26*b* are formed along the bottom surface of the first dielectric members 27*a* on the boundaries of discharge cells 17 adjacent to each other along the second direction, stepped portions are formed between the expanded portions 26*a* and the connecting portions 26*b*. That is, the connecting portions 26*b* are arranged further from the front substrate 20 in the third (z) direction than the expanded portions 26*a*.

Therefore, the first apertures 40 that communicate with each other along the first direction are formed between connecting portions 26*b* adjacent to each other along the second direction. A width of the first apertures 40 is substantially equal to a width of the discharge cells 17 measured along the second direction. Due to the first apertures 40, the exhaust efficiency and the quality of display of the PDP can be improved.

A partial area of the scan electrodes 26 that face the sustain electrodes 25 on the boundaries of discharge cells 17 adjacent to each other along the second direction is smaller than a partial area of the scan electrodes 26 that face the sustain electrodes 25 across the discharge cells 17. That is, a length (L3) of the connecting portions 26*b* measured along the second direction is smaller than a length (L4) of the expanded portions 26*a* measured along the second direction, and a length (L5) of the connecting portions 26*b* measured along the third direction is smaller than a length (L6) of the expanded portions 26*a* measured along the third direction.

As stated above, as the area of the scan electrodes 26 on the boundaries of adjacent discharge cells 17 is reduced, power consumption can be reduced and efficiency of luminescence can be improved. In other words, a part of scan electrodes 26 that substantially affects gas discharge is in the inner part of the discharge cells 17, and a part of scan electrodes 26 that is located on the boundaries of discharge cells 17 hardly affects the gas discharge. That is, the part of scan electrodes 26 that is formed on the boundaries of discharge cells 17 functions just as a connecting wire and hardly affects the discharge. Therefore, according to the present invention, although part of the connecting portions 26*b* that is formed on the boundaries of discharge cells adjacent to each other along the second direction has a reduced area, there is no effect on the gas discharge.

Capacitance C has characteristics that it is proportional to an area of an electrode and inversely proportional to a distance between electrodes. Therefore, the capacitance C of the scan electrodes 26 that include the connecting portions 26*b* according to the present embodiment decreases dramatically as the area of parts of the scan electrodes that are on the boundaries of adjacent discharge cells 17 is drastically reduced. In addition, as capacitance decreases, recharge current is reduced, thus power consumption is reduced and efficiency of luminescence is improved.

Figure 5:
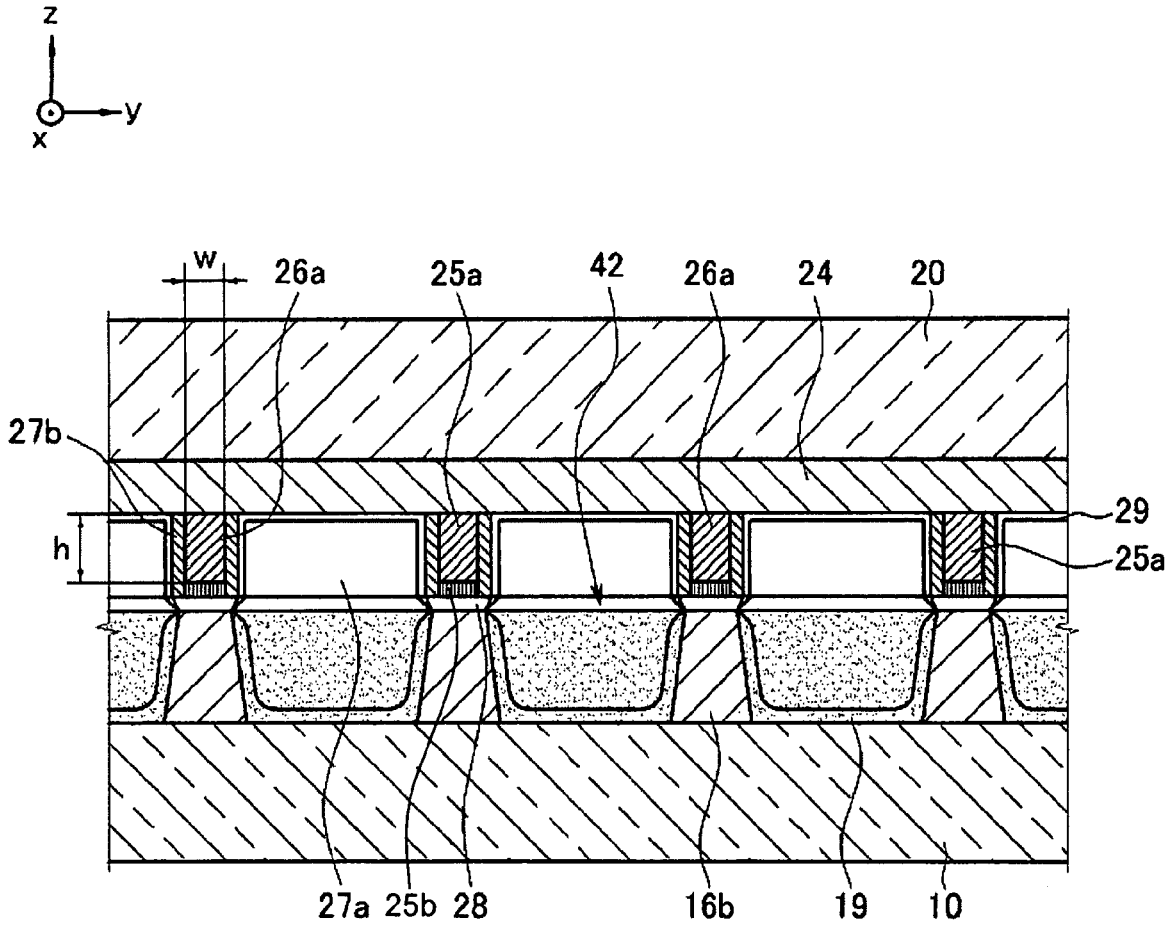
FIG. 5 is a cross-sectional view showing the assembled PDP, taken along line V-V in FIG. 2.

Referring to FIG. 5, a cross-section of the expanded portions 25*a* of the sustain electrodes 25 and a cross-section of the expanded portions 26*a* of the scan electrodes 26 have a dimension h along the third direction (z-axis direction in the drawings) that is greater than a dimension w along the first direction (y-axis direction in the drawings). That is, the height of the sustain electrodes 25 and the scan electrodes 26 from the surface of the front substrate 20 is greater than the width. By increasing the height of the sustain electrodes 25 and the scan electrodes 26, even if the size of the discharge cell along a planar direction is diminished, the decrement of size can be compensated for. Furthermore, by enlarging the surface of the sustain electrodes 25 and the scan electrodes 26 facing each other, the efficiency of luminescence can be higher than that of the surface discharge PDP.

The expanded portions 25*a* of the sustain electrodes 25 and the expanded portions 26*a* of the scan electrodes 26 are covered by the first, second, and third dielectric members 27*a*, 27*b*, and 28. The first, second, and third dielectric members 27*a*, 27*b*, and 28 can be made of the same material, thus protecting each electrode against collision with electrical charges generated during a gas discharge. Wall charges can accumulate on the dielectric layer 24 and the second dielectric members 27*b*, thus lowering the discharge firing voltage during a sustain discharge between the sustain electrodes 25 and the scan electrodes 26.

The protective layer 29 can be formed on the surfaces of the dielectric layer 24 and the second dielectric members 27*b*. It is preferred that the protective layer 29 is formed on the surface of the dielectric layer 24 that is exposed to gas discharge. An example of the protective layer 29 can be a MgO protective layer 29. The MgO protective layer 29 protects dielectric layers against collision with ions that are dissociated during the gas discharge. The MgO protective layer 29 can improve the efficiency of discharge due to a high secondary electron emission factor when colliding with the ions.

Referring to FIGS. 2 and 5, in the present embodiment, the third dielectric members 28 that are formed at intersections of the first dielectric members 27*a* and the second dielectric members 27*b* protrude toward the rear substrate 10. Therefore, second apertures 42 that communicate with each other along the second direction (x-axis direction in the drawings) are formed between the third dielectric members 28 that are adjacent to each other along the first direction (y-axis direction in the drawings). As stated above, since the second apertures 42 are formed, the exhaust efficiency and the quality of display of the PDP can be improved. The structure of the second apertures 42 is described in more detail with regard to FIG. 6.

Figure 6:
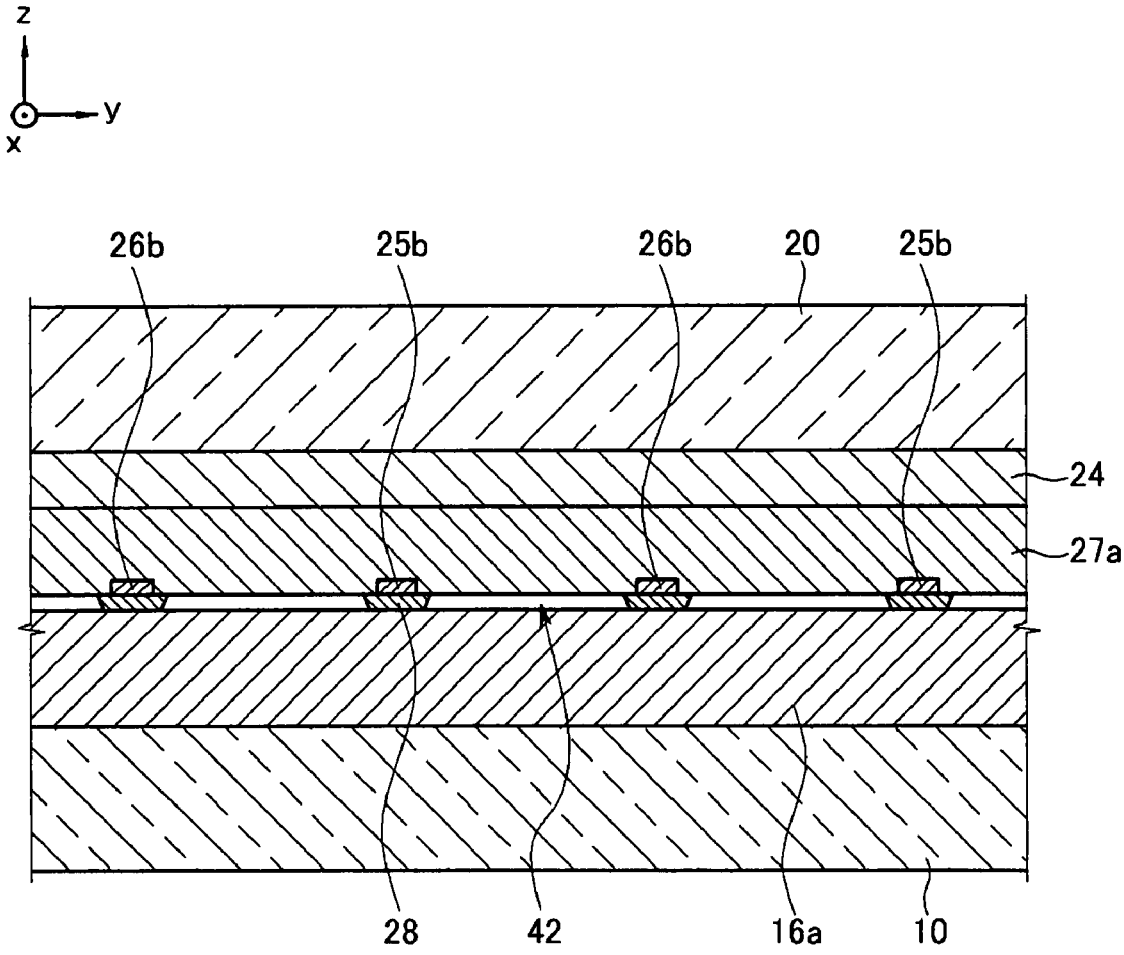
FIG. 6 is a cross-sectional view showing the assembled PDP, taken along line VI-VI in FIG. 2.

Referring to FIGS. 2 and 6, the connecting portions 25*b* of the sustain electrodes 25 and the connecting portions 26*b* of the scan electrodes 26 are formed on the boundaries of discharge cells 17 adjacent to each other along the second direction. As described above, the connecting portions 25*b* and 26*b* protrude toward the rear substrate 10 and respectively form stepped portions from the expanded portions 25*a* and 26*a*, and the third dielectric members 28 are formed to cover the connecting portions 25*b* and 26*b* and the expanded portions 25*a* and 26*a*, thus part of the third dielectric members 28 that corresponds to the connecting portions 25*b* and 26*b* also forms stepped portions. Therefore, the second apertures 42 that communicate with each other along the second direction (x-axis direction in the drawings) are formed between the connecting portions 25*b* and 26*b* that are adjacent to each other along the first direction (y-axis direction in the drawings).

As stated above, since the second apertures 42 communicate with discharge cells 17 adjacent to each other along the second direction, the exhaust efficiency and the quality of display of the PDP can be improved. In the present embodiment, apertures are formed in a radial pattern around discharge cells 17, thus the exhaust efficiency is drastically improved (refer to FIG. 4 and FIG. 6).

The following is a detailed description of a manufacturing method of the above-described PDP with regard to FIGS. 7 through 12. In the present embodiment, processes of forming barrier ribs 16 on the rear substrate 10 and forming address electrodes 22 and a dielectric layer 24 to cover the address electrodes 22 on the front substrate 20 can take place in a generally-known way, and a detailed description thereof is omitted.

Figure 7:
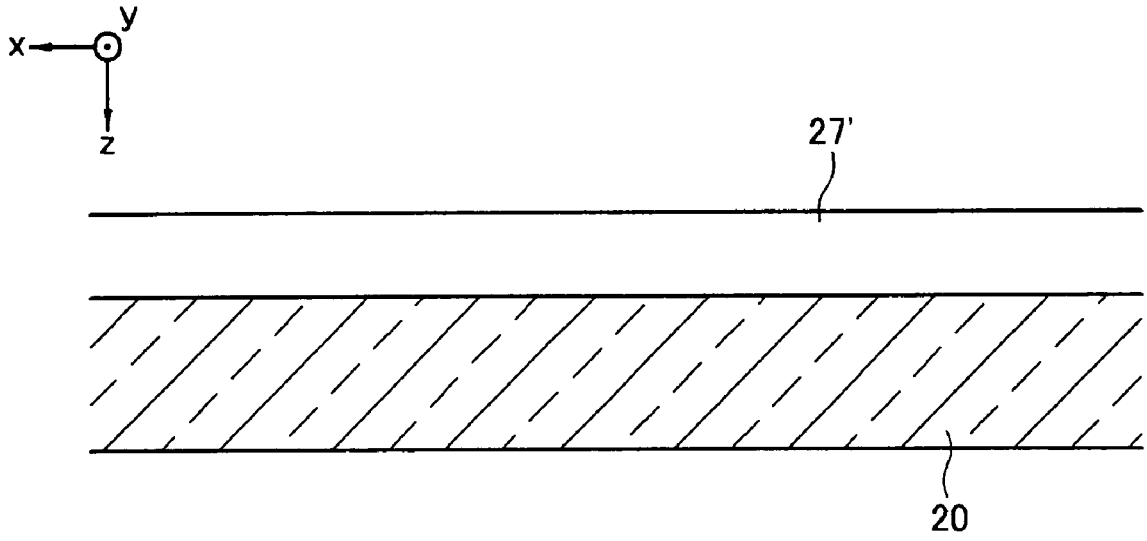
FIG. 7 is a cross-sectional view showing a first dielectric layer formed on a front substrate in a manufacturing process of the PDP according to the first embodiment of the present invention.

In a manufacturing method of a PDP according to the present invention, after the address electrodes 22 and the dielectric layer 24 are formed on the front substrate 20, a dielectric paste 27' is formed on the front substrate 20 (refer to FIG. 7). Since the dielectric paste 27' forms grooves 50 for discharge spaces and grooves 60 for electrodes through etching, it is preferred that the dielectric paste 27' is thick enough to form discharge spaces.

Figure 8:
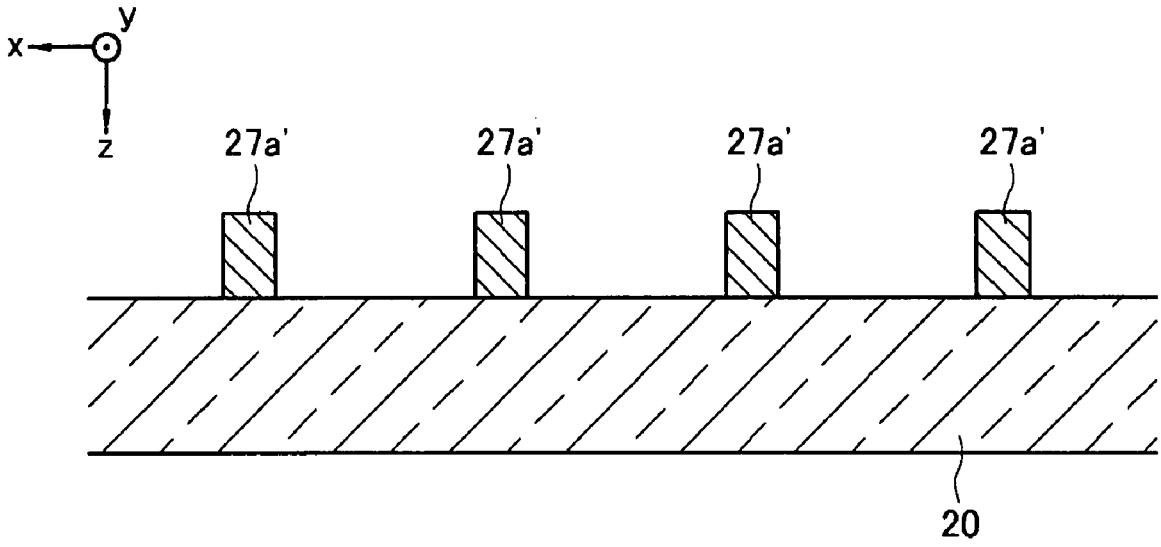
FIG. 8 is a cross-sectional view showing the first dielectric layer etched in the manufacturing process of the PDP according to the first embodiment of the present invention.
Figure 9:
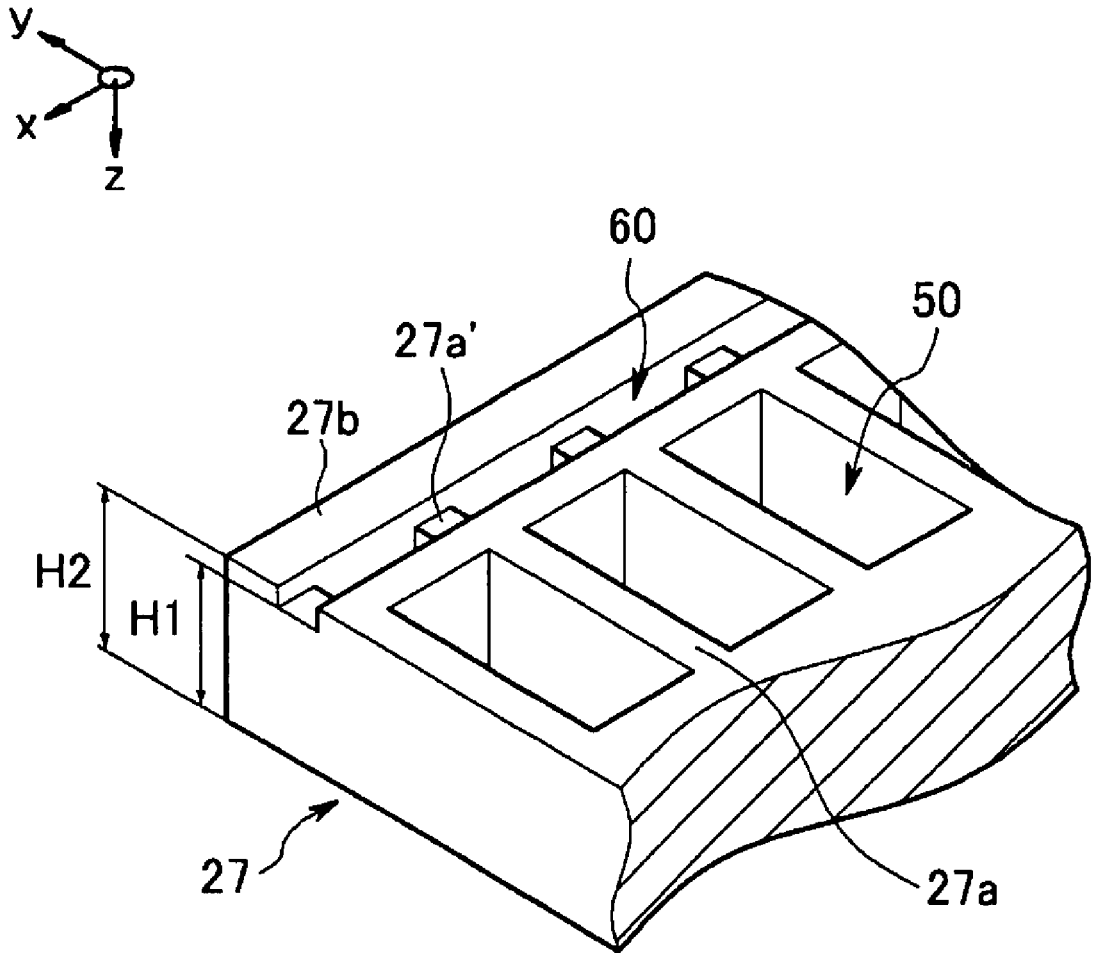
FIG. 9 is a partial perspective view showing grooves for discharge spaces and grooves for electrodes that are formed by etching the first dielectric layer in the manufacturing process of the PDP according to the first embodiment of the present invention.

Afterwards, the dielectric paste 27' is dried and fired to form a first dielectric layer 27, and then the first dielectric layer 27 is etched to form the grooves 50 for discharge spaces and the grooves 60 for electrodes. That is, by etching the first dielectric layer 27 with a method such as sand blasting or etching, first dielectric members 27*a* and second dielectric members 27*b* that define the grooves 50 for discharge spaces and the grooves 60 for electrodes are formed. For the sake of understanding, only the first dielectric members 27*a'* defining the grooves 60 for electrodes are shown in FIG. 8.

In the present embodiment, when the first dielectric members 27*a* and the second dielectric members 27*b* are formed, the extent of etching of the first dielectric layer 27 is controlled so that the first dielectric members 27*a* and the second dielectric members 27*b* have different heights. In other words, referring to FIG. 9, heights of the first dielectric members 27*a* and the second dielectric members 27*b* measured along the third direction (z-axis direction in the drawings) are the same. However, a height H1 of the first dielectric members 27*a'* that define the grooves 60 for electrodes is smaller than a height H2 of the second dielectric members 27*b*. As stated above, the height H1 of the first dielectric members 27*a'* are formed to be smaller than the height H2. Thus, a problem that electrode paste flows into the grooves 50 for discharge spaces when the electrode paste is distributed along the second direction (x-axis direction in the drawings) can be prevented.

The grooves 50 for discharge spaces and the grooves 60 for electrodes can be formed individually or simultaneously. When the first dielectric layer 27 is etched, the grooves 50 for discharge spaces and the grooves 60 for electrodes can be etched at a time with a method such as sand blasting or etching, thus there is an advantage of a simpler process of manufacturing.

Figure 10:
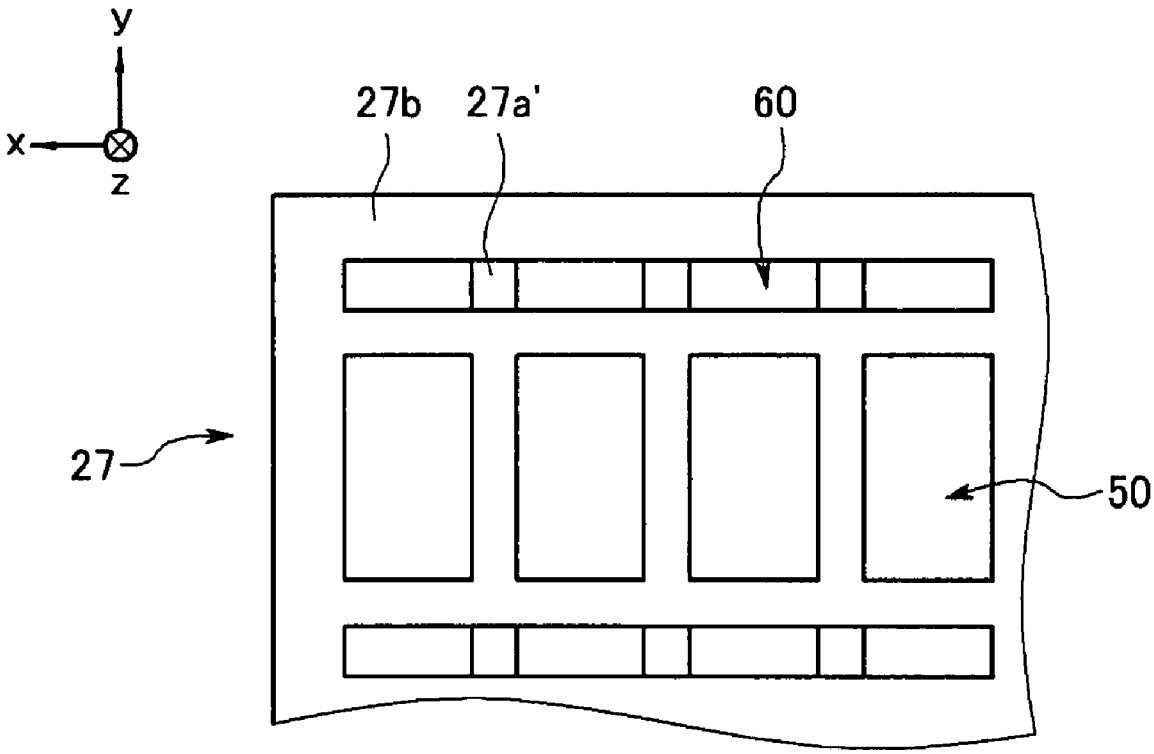
FIG. 10 is a plan view showing the grooves for discharge spaces and the grooves for electrodes that are formed by etching the first dielectric layer in the manufacturing process of the PDP according to the first embodiment of the present invention.

Referring to FIG. 10, the plurality of grooves 50 for discharge spaces and the grooves 60 for electrodes are shown arranged along the second direction. Since the grooves 60 for electrodes are formed to face each other with the grooves 50 for discharge spaces therebetween, electrodes with an opposed discharge structure can be easily manufactured.

Afterwards, electrode paste is continuously distributed along the second direction (x-axis direction in the drawings), and is dried and fired to form the sustain electrodes 25 or the scan electrodes 26. That is, when electrode paste is distributed, it is continuously distributed along the second direction.

Therefore, stepped portions can be formed between an electrode paste that is filled into the grooves 60 for electrodes and an electrode paste that passes the first dielectric members 27*a*'.

Figure 11:
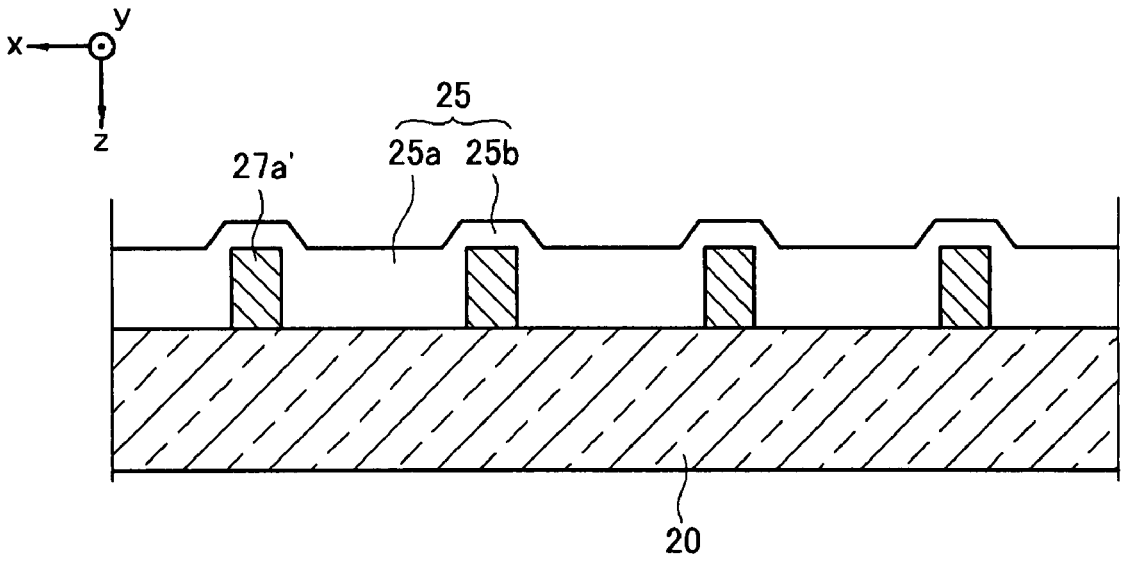
FIG. 11 is a cross-sectional view showing sustain electrodes formed by distributing electrode paste along a certain direction in the manufacturing process of the PDP according to the first embodiment of the present invention.

As shown in FIG. 11, for example, sustain electrodes 25 include the expanded portions 25*a* formed by the electrode paste that is filled into the grooves 60 for electrodes, and the connecting portions 25*b* formed by the electrode paste that passes over the first dielectric members 27*a*' and forms stepped portions from the expanded portions 25*a*. The electrode paste that forms the grooves 60 for electrodes can be formed by pattern printing or with a dispenser.

Figure 12:
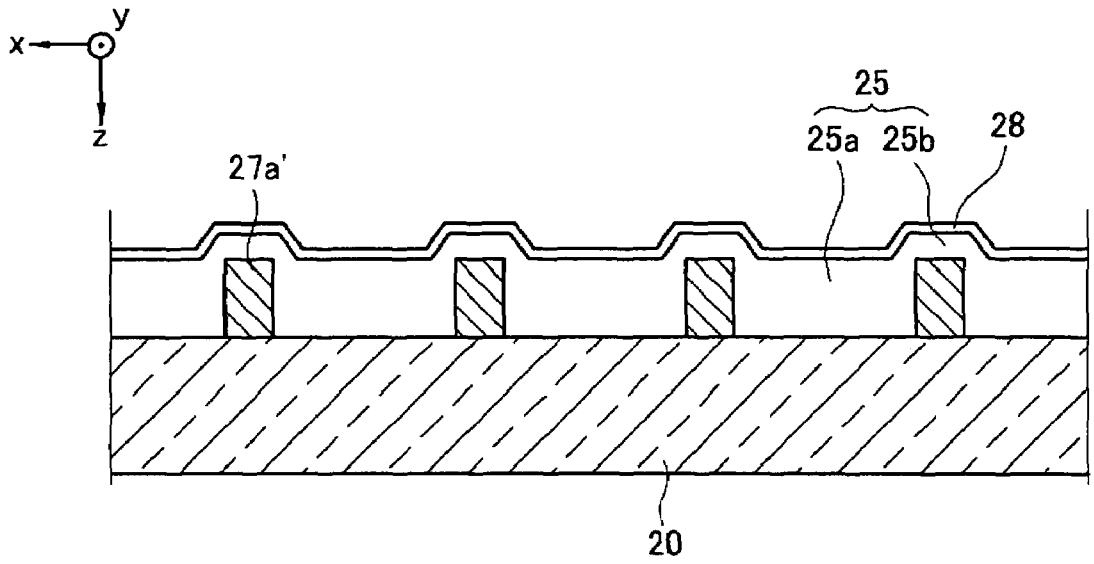
FIG. 12 is a cross-sectional view showing a second dielectric layer formed to cover the sustain electrodes in the manufacturing process of the PDP according to the first embodiment of the present invention.

Afterwards, the third dielectric members 28 are formed to cover the sustain electrodes 25 as illustrated in FIG. 12. The third dielectric members 28 can be applied by a method such as pattern printing. As stated above, since the connecting portions 25*b* of the sustain electrodes 25 form stepped portions from the expanded portions 25*a*, a part of the third dielectric members 28 that is formed in the area corresponding to the connecting portions 25*b* forms stepped portions from another part of the third dielectric members 28 that is formed in the area corresponding to the expanded portions 25*a*. Therefore, when the front substrate 20 formed in the above-described way is sealed to the rear substrate 10 to manufacture a PDP, exhaust passages are formed between the connecting portions 25*b* and the exhaust efficiency is improved.

Although certain exemplary embodiments of the present invention have been shown and described, the present invention is not limited to the described embodiments, but can be modified in various forms without departing from the scope of the invention set forth in the detailed description, the accompanying drawings, the appended claims, and their equivalents.

What is claimed is:

1. A plasma display panel (PDP), comprising:

a first substrate;

a second substrate facing the first substrate;

a plurality of discharge cells partitioned between the first substrate and the second substrate;

a plurality of phosphor layers arranged within the plurality of discharge cells;

a plurality of address electrodes extending in a first direction on the second substrate; and a plurality of first electrodes and a plurality of second electrodes extending in a second direction that crosses the first direction, arranged between the first substrate and the second substrate, arranged apart from the plurality of address electrodes, and protruding in a third direction away from the second substrate, wherein the plurality of first electrodes and the plurality of second electrodes face each other with a space therebetween, wherein each of the plurality of first electrodes and each of the plurality of second electrodes respectively include a plurality of expanded portions corresponding to respective ones of the plurality of discharge cells and extending in the third direction, and a plurality of connecting portions connecting ones of the plurality of expanded portions in the second direction and forming stepped portions therefrom, and wherein a plurality of first apertures that communicate with the plurality of discharge cells adjacent to each other along the first direction are arranged between the ones of the plurality of connecting portions that are adjacent to each other in the second direction.

2. The PDP of claim 1, wherein each of the plurality of first electrodes and each of the plurality of second electrodes are arranged alternately along the first direction and are arranged to pass a boundary between ones of the plurality of discharge cells that are adjacent to each other along the first direction.

3. The PDP of claim 2, wherein the plurality of connecting portions are located within a boundary between ones of the plurality of discharge cells that are adjacent to each other along the second direction, and a plurality of second apertures are arranged between ones of the plurality of connecting portions that are adjacent to each other along the first direction, and communicate with ones of the plurality of discharge cells that are adjacent to each other along the second direction.

4. The PDP of claim 1, wherein a length of ones of the plurality of connecting portions measured along the second direction is smaller than a length of ones of the plurality of the expanded portions measured along the second direction, and a length of ones of the plurality of connecting portions measured along the third direction is smaller than a length of ones of the plurality of expanded portions measured along the third direction.

5. The PDP of claim 1, wherein ones of the plurality of connecting portions are arranged further along the third direction from the second substrate than ones of the plurality of expanded portions.

6. The PDP of claim 1, further comprising a first dielectric layer and a second dielectric layer are arranged on surfaces of the plurality of first electrodes and the plurality of second electrodes, wherein the first dielectric layer comprises a plurality of first dielectric members extending along the first direction and a plurality of second dielectric members extending along the second direction that crosses the first dielectric members, and wherein the second dielectric layer comprises a plurality of third dielectric members extending along the second direction on the plurality of second dielectric members.

7. The PDP of claim 6, wherein a plurality of first discharge spaces are defined by the plurality of first, second, and third dielectric members.

8. The PDP of claim 7, further comprising a plurality of barrier ribs arranged on the first substrate and partitioning a plurality of second discharge spaces that face the plurality of first discharge spaces, the plurality of discharge cells being defined by the plurality of first and second discharge spaces.

9. The PDP of claim 8, wherein the plurality of barrier ribs comprise:

a plurality of first barrier rib members that correspond to the plurality of first dielectric members and extend along the first direction; and a plurality of second barrier rib members that correspond to the second and third dielectric members respectively and extend along a direction crossing the plurality of first barrier rib members, wherein the plurality of phosphor layers are arranged on the sides of the plurality of first and second barrier rib members and on the first substrate.

10. The PDP of claim 1, wherein the plurality of address electrodes include a plurality of bus electrodes extending along the first direction and a plurality of transparent electrodes protruding from ones of the plurality of bus electrodes into centers of respective ones of the plurality of discharge cells, and wherein the plurality of bus electrodes are arranged on boundaries of the plurality of discharge cells that are adjacent to each other along the second direction.

11. The PDP of claim 10, wherein the plurality of transparent electrodes are arranged closer to ones of the plurality of second electrodes than to ones of the plurality of first electrodes.

12. A method, comprising:

forming a first dielectric layer on a substrate;

etching the first dielectric layer to form a first plurality of grooves for a plurality of discharge spaces and a second plurality of grooves for a plurality of first and second electrodes that are defined by a plurality of first dielectric members and a plurality of second dielectric members that cross the plurality of first dielectric members;

continuously distributing an electrode paste into the second plurality of grooves that are arranged along a second direction crossing the first direction, and on parts of the plurality of first dielectric members to form the plurality of first and second electrodes protruding in a third direction away from the second substrate, wherein the plurality of first electrodes and the plurality of second electrodes face each other with a space therebetween, wherein each of the plurality of first electrodes and each of the plurality of second electrodes respectively include a plurality of expanded portions corresponding to respective ones of the plurality of discharge cells and extending in the third direction, and a plurality of connecting portions connecting ones of the plurality of expanded portions in the second direction and forming stepped portions therefrom, and wherein a plurality of first apertures that communicate with the plurality of discharge cells adjacent to each other along the first direction are arranged between the ones of the plurality of connecting portions that are adjacent to each other in the second direction; and forming a plurality of third dielectric members along the second direction and covering the plurality of first and second electrodes.

13. The method of claim 12, wherein the first dielectric layer is etched by a sand blasting process.

14. The method of claim 12, wherein the first dielectric layer is etched by an etching process.

15. The method of claim 12, wherein the first plurality of grooves and the second plurality of grooves are formed simultaneously.

16. The method of claim 12, wherein, during the forming of the grooves for the plurality of discharge spaces and the grooves for the plurality of electrodes, a height of ones of the plurality of first dielectric members that define the second plurality of grooves for the plurality of first and second electrodes measured from the substrate is formed to be greater than a height of ones of the plurality of second dielectric members.

17. The method of claim 16, wherein the forming of the plurality of first and second electrodes comprises:

distributing continuously the electrode paste along the second direction; and forming a plurality of expanded portions that are filled into the second plurality of grooves and a plurality of connecting portions that are formed on the first dielectric members to form the plurality of stepped portions from the plurality of expanded portions and connect the plurality of expanded portions along the second direction.

18. The method of claim 12, wherein the electrode paste is filled into the second plurality of grooves by a dispenser.

19. The method of claim 12, wherein the electrode paste is formed in the second plurality of grooves by a pattern printing process.

20. The method of claim 12, wherein the plurality of third dielectric members are formed by a pattern printing process.

* * * * *